United States Patent [19]

Olovson

[11] Patent Number: 4,794,672

[45] Date of Patent: Jan. 3, 1989

[54] QUICKLY ATTACHABLE BUTTON ARRANGEMENT

[76] Inventor: Gudmar Olovson, 64 rue Saint Charles, 75015 Paris, France

[21] Appl. No.: 126,938

[22] PCT Filed: Apr. 15, 1987

[86] PCT No.: PCT/SE87/00190

§ 371 Date: Nov. 18, 1987

§ 102(e) Date: Nov. 18, 1987

[87] PCT Pub. No.: WO87/06109

PCT Pub. Date: Oct. 22, 1987

[30] Foreign Application Priority Data

Apr. 18, 1986 [SE] Sweden ..... 8601767

[51] Int. Cl.[4] ..... A44B 1/18

[52] U.S. Cl. ..... 24/112; 24/90 R; 24/103; 24/105; 411/2; 411/5

[58] Field of Search ..... 24/112, 111, 103, 104, 24/105, 90 R; 411/2, 3, 4, 5

[56] References Cited

U.S. PATENT DOCUMENTS

| | | | |
|---|---|---|---|
| 352,712 | 11/1886 | Riker | 24/112 |
| 649,656 | 5/1900 | Brooks | 24/112 |
| 1,375,231 | 4/1921 | Rovelli | 24/105 |
| 2,104,885 | 1/1938 | Robbins | 24/90 R |
| 2,188,552 | 1/1940 | King et al. | 24/90 R |
| 3,343,443 | 9/1967 | Moore | 411/5 |
| 3,349,447 | 10/1967 | Raleigh, Jr. | 24/90 R |
| 3,925,855 | 12/1975 | Olovson | 24/103 |
| 4,096,901 | 6/1978 | Reichenbach | 411/3 |
| 4,232,427 | 11/1980 | Mawhinney et al. | 24/103 |

FOREIGN PATENT DOCUMENTS

| | | | |
|---|---|---|---|
| 1119434 | 6/1956 | France | 411/2 |
| 331922 | 8/1969 | Sweden . | |
| 418050 | 5/1981 | Sweden . | |

*Primary Examiner*—Victor N. Sakran

*Attorney, Agent, or Firm*—Burns, Doane, Swecker & Mathis

[57] ABSTRACT

Quickly attachable button arrangement (1) comprising a button head (2) having integrally formed therewith a combined button-head holding and attachment device (5) for holding the button head on and attaching the button head to a piece of material (3). The button-head holding part (5*a*) comprises one or more surfaces (4*a*, 4*b*, 4*c*) or the like which are located at a distance from the button head and face theretowards, and the button-head attachment part (5*b*) comprises a material-piercing needle-like part. The holding part (5*a*) is intended to abut the side (3*a*) of the material (3) located on the opposite side of the button head (2), therewith to hold the button head to the other side (3*b*) of the material. The holding part (5*a*) has a helical and/or spiral form and the holding part (5*a*) is intended to follow the attachment part (5*b*) through the material as the button arrangement is twisted.

10 Claims, 1 Drawing Sheet

QUICKLY ATTACHABLE BUTTON ARRANGEMENT

TECHNICAL FIELD

The present invention relates to a button arrangement, and more specifically, although not exclusively, to a quickly-attachable button arrangement constructed in a manner to enable it to be secured to a piece of material irrespective of whether the material is provided with a hole therefore or not.

The button arrangement can be used to secure labels and the like.

The quickly-attachable button arrangement is primarily intended as a spare button for replacing temporarily a button that has inadvertently been lost from the article on which it was sewn.

The button arrangement according to the invention comprises a button head having formed integrally therewith a combined button-head attachment and holding device, these devices being formed integrally with the button head. The button-head holding part of the device has provided thereon one or more surfaces or the like which are spaced from and face towards the button head, and the button-head attachment part of which device consists of a needle-like part which is intended to pierce the material, i.e. cloth or fabric, to which the button is to be attached.

The button-head holding device of this kind of button arrangement is intended to lie against the surface of the material opposite the button head, in a manner to hold the button head firmly on the material.

The button-head holding device has a helical and/or spiral form, thereby to enable the attachment part and the holding part of the combined device to be screwed through the material.

BACKGROUND PRIOR ART

Swedish Published Specification No. 418 050 and its counterpart U.S. Pat. No. 3,925,855, published on Dec. 16, 1975 and having the same inventor and applicant as the present invention, teach a quickly-attachable button arrangement that comprises a button head and a combined button-head attachment and holding device in the form of a one-piece structure. In this case, the button-head holding part of the combination device comprises a plurality of barbs which face towards the button head at a distance therefrom, and the button attachment part of the device comprises an elongated, needle-like part, the end of which distal from the button head is hard and pointed and the intermediate part of which connected to the button-head holding device and adjacent to the button head is resilient or elastic.

The barbs located on the button-head holding part are intended to engage the material on the side thereof opposite the button head, in a manner to hold the button head firmly on the material. The button-head attachment part of the device has a form which enables it to penetrate the material to which the button arrangement is to be attached.

A particular feature of the known quick-attachment button arrangements is that they present a part which is so elastic that when the button-head attachment part of said device is pushed or screwed through the material and subjected to a tension or pulling force, the barbs will pass through the material and take a position spaced therefrom. When the tension force is removed from the combined attachment and holding device, the barbs move into holding engagement with the material as the elastic attachment device retreats.

The barbs extend laterally over a relatively wide area beyond the attachment device, such as to form one or more material support surfaces when engaging the aforesaid opposite side of the material. These support surfaces must be located adjacent a counter-support provided on the button head, such that the material will be held firmly between the counter-support and the support surfaces when the button arrangement is used.

The elongated needle-like button attachment part of said device is given a hardness which increases progressively from the button head to the point of said attachment part.

This known button arrangement may also be provided with recesses at a location inwardly of those parts of the barbs that are located nearest the needle-like part of the button-head attachment device, these recesses facilitating removal of the needle-like part.

The button-head attachment device illustrated and described in Swedish Patent Specification No. 331 922 also forms part of the known prior art.

This attachment device is intended for securing a button head or a label to an article of clothing which comprises at least two layers of material.

This attachment device has the form of a rigid needle which is bent to form firstly a shank part which is located substantially centrally of the button head and projects rearwardly from the rear side thereof, or preferably from a button-like projection formed in the vicinity thereof, secondly an arcuately curved part which has a free, pointed end and forms an open loop that encircles the shank part in a plane substantially perpendicular thereto, and thirdly an intermediate part which connects the shank with the outer needle part and has the form of a clamp-like hook part which extends radially and projects slightly outside the plane of the outer needle part and the radial outer part of which is located essentially in the same plane as the outer needle part and merges therewith through a laterally extending and rounded knee, wherewith the outer needle part has a length which is so restricted as to form an opening between its free, pointed end and the knee, such that the outer needle part and the intermediate part together have a configuration resembling the letter "G" when seen from one side.

Furthermore, the free end part of the needle-part of the device shall be gently curved inwardly towards the shank part, so as to form a hook which lies in the plane of the outer needle part and the point of which, representing the free pointed end of the outer needle, is directed radially towards but spaced radially from the shank part of the device and is located substantially opposite to but spaced from the central region of the intermediate part of the needle, by a distance which is roughly twice as large as the radial dimension of the hook.

SUMMARY OF THE INVENTION

Technical Problems

When considering the state of the prior art as described in the aforegoing it will be seen that a highly qualified technical problem resides in the provision of a useful quickly-attachable button arrangement with which the size of the hole formed by the button-head attachment and button-head holding devices in the material, in order to permit the barbs to pass therethrough, can be reduced to a minimum while still enabling the button to be held firmly on the material.

It will also be seen that a qualified technical problem in this regard resides in the provision of a quickly-attachable button arrangement with which the hole required in the material in order to fit the button can be minimized while still providing conditions which will enable the surface which is intended to co-act with and hold the button head against the material to present a wide abutment surface, by providing abutment surfaces which are located a small distance from the hole formed in the material.

A further technical problem in connection with quickly-attachable button arrangements of this kind is one of providing features which will reduce the elastic requirements of certain parts of the button arrangement when the button-head attachment device is inserted through the material, thereby obviating the need to exert on the part located between the button-head holding surface and the button head itself a tension force of such magnitude as to extend said part elastically to an extent such that the whole of the barbed section in its axial extension is forced to pass through the material and, in so doing, caused to take a position at a considerable distance from the button head.

It will be seen that with a quickly-attachable button arrangement of the aforesaid kind, a further problem resides in the provision of features which will enable the button to be pushed through the material in a normal linear piercing movement and then to be brought into position by rotating the button head.

Another qualified technical problem is one of perceiving that the button-head attachment part and the button-head holding part of such button arrangements should be given a helical and/or spiral form, thereby to enable the button-head holding part of the arrangement to be screwed through the material and therewith to reduce the size of the hole that need be pierced in the material, and also the need to adapt the button arrangement to a given material thickness.

It will also be seen that a further qualified technical problem resides in the provision of a quickly-attachable button arrangement of the aforesaid kind in which the button-head holding surfaces have a form which well suits their intended function.

It will be seen that another qualified technical problem is one of providing conditions in a quickly-attachable button arrangement of the aforesaid kind and of very small dimensions that will enable a weakening to be incorporated in a common part located between the button-head holding part and the button-head attachment part, and therewith placed slightly inwardly of the attachment device.

In order to facilitate the insertion of the attachment part and the holding part, solely the attachment part and the holding part are provided with helically extending flutes in accordance with the invention. With regard to the known prior art as disclosed in the aforesaid publications, another qualified technical problem is one of providing the button-head attachment part with a point, preferably a hard point, and of providing a portion of the said attachment part spaced from the point with helically extending flutes for promoting a screwing action.

Still another qualified technical problem is one of creating in quickly-attachable button arrangements of the aforesaid kind conditions which will enable the button-head attachment part of the arrangement to taper gently towards the point of said part, despite the small dimensions of the button arrangement.

Solution

The present invention relates to a quickly-attachable button arrangement comprising a button head which is formed integrally with a combined button-head holding and attachment device, this device being intended to co-act with a piece of material in a manner to secure the button head thereto. The button-head holding part of the device comprises one or more abutment surfaces or the like which are spaced from the button head and directed theretowards, and the button-head attachment part of the device has the form of a needle-like part which is intended to penetrate the material, the button-head holding part being intended to lie against the side of the material opposite the button head in a manner to hold the button head firmly on the material.

The button-head holding part has a helical and/or spiral form, and said button-holding part is intended to pass through the material when twisting the holding and/or the attachment device about its longitudinal axis.

In accordance with the invention the button-head attachment part of the aforesaid device comprises a pointed part and a helical and/or spiral part which faces towards the button head and which is provided with a weakening which enables the attachment part of the device to be broken-off so as to leave a part which serves to hold the button head.

According to one embodiment of the invention the button-head attachment part has provided thereon a helix which has two leads and which extends along less than half the length of said attachment part.

It is also proposed in accordance with the invention that the weakening shall be located from the button-head holding part of the device at a distance which is equal to about half the pitch of the helix.

The thread of the helix may have the form of a triangular band arranged around a cylindrical, or substantially cylindrical elongated part which tapers towards one end thereof.

The pitch of the helix shall exceed the width of the band along the cylindrical elongated part by a factor of three (3) and shall be smaller than the width of the band along the cylindrical elongated part by a factor of ten (10), preferably by a factor of about six (6).

In accordance with one embodiment of the invention, the weakening has the form of a hole formed in the button-head attachment part of the device. The weakening is positioned in a region on the attachment part where a boundary can be expected to lie between the button-head attachment part and the button-head holding part of the combination device.

The weakening consists of a triangular hole.

Advantages

The advantages primarily afforded by a quickly-attachable button arrangement constructed in accordance with the invention are that the button arrangement can be fastened readily to a piece of material without requiring too large a hole for the button-head attachment and holding parts of the device to pass therethrough.

The device is inserted through the material with the aid of a twisting or screwing action.

BRIEF DESCRIPTION OF THE DRAWING

A preferred embodiment of a quickly-attachable button arrangement having features significant of the invention will now be described in more detail with reference to the accompanying drawing; in which.

DESCRIPTION OF A PREFERRED EMBODIMENT

Figure 1:
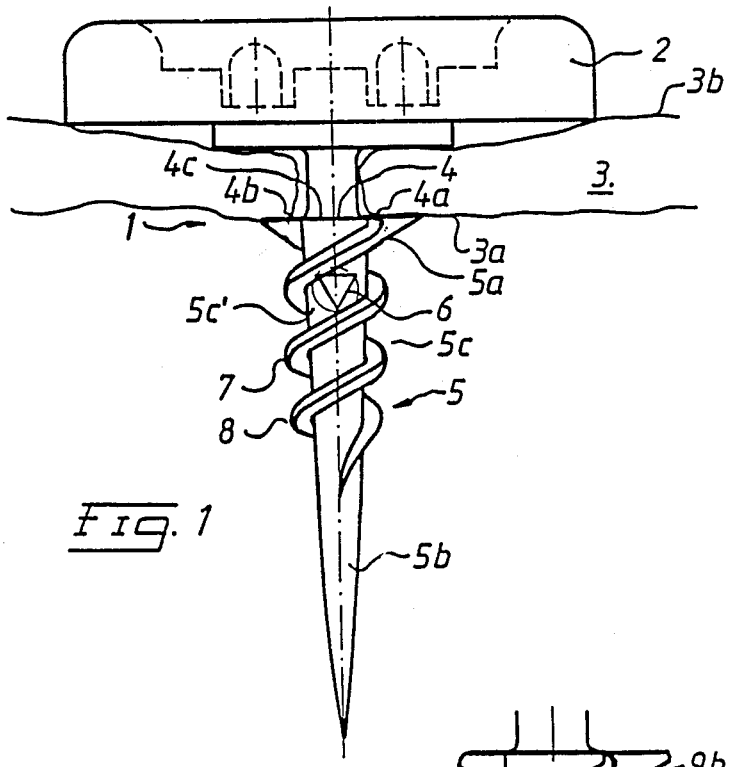
FIG. 1 is a side view of one embodiment of a quickly-attachable button arrangement according to the invention.
Figure 2:
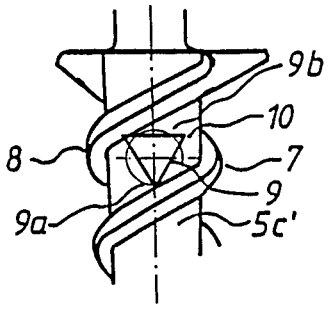
FIG. 2 illustrates, in larger scale part, of the button arrangement shown in FIG. 1 at a location between the combined button-head holding and attachment device.

Thus the drawing illustrates an embodiment of a quickly-attachable button arrangement according to the invention.

The button arrangement illustrated in FIG. 1 is identified by the reference number 1, whereas the reference numeral 2 identifies a button head 2 forming part of the button arrangement. The button head 2 has formed integrally therewith a holding and attachment device 5 by means of which the button arrangement is attached to a piece of material 3. Since this device has the form of a single-piece structure, the holding part of the device is referenced 5*a* in FIG. 1 and the attachment part is referenced 5*b*. In the illustrated embodiment the holding part 5*a* presents one or more surfaces 4 or the like which are spaced from the button head 2 and face theretowards and which are capable of penetrating the aforesaid material.

The button-head attachment part 5*b* of the combination device has at its free end a pointed, needle-like part which is intended to form a precursor for the holding part 5*a* of the device.

When attaching the button arrangement, the pointed, needle-like part thereof is inserted through the material and the whole of the button arrangement is then twisted about the axis of the attachment and holding device, whereupon the uppermost part of the attachment part 5*b* passes through the material and is immediately followed by the holding part 5*a*.

When the button-head holding part 5*a* is located in a position in which it engages the material 3, the surfaces 4 abut the side 3*a* of the material 3 located opposite the button head 2, and therewith secure the button head against the other or opposite side 3*b* of the material.

In accordance with the invention, the button-head holding part 5*a* has a helical and/or spiral form similar to the attachment part 5*b*, and the holding part 5*a* is also intended to be screwed through the material 3.

In accordance with the invention, the button-head holding part 5*a* presents a plurality of mutually adjacent surfaces, namely the surfaces 4*a* and 4*b* of a helical configuration and a smaller circular surface 4*c*.

According to the present invention the button-head attachment part of the combination device comprises a pointed section 5*b* and a helically shaped and/or spirally shaped section 5*c*. The latter section 5*c* incorporates a weakening 6, which is intended to facilitate removal of the sections 5*b* and 5*c* of the button-head attachment part, so as to leave solely the holding part 5*a*.

The helix provided on the section 5*c* of the attachment part has two leads. In this embodiment the helix extends through a distance which is smaller than half the longitudinal extension of the attachment part.

The weakening 6 is located at a distance from the surface 4 that corresponds to half the pitch of the helix.

Although the illustrated button-head attachment part of the device according to the invention has, together with its helix, the form of a single-piece structure, it is proposed that the helix comprises a triangular band 7 and 8 respectively that extend around an elongated cylindrical, or substantially cylindrical section 5*c*.

The band has a pitch which exceeds the width of the band along the cylindrical elongated section 5*c*' by a factor of three (3).

The pitch of the helix is also chosen to be smaller than the width of the band along the cylindrical elongated part by a factor of ten (10) preferably a factor of about six (6).

The weakening 6 is located within a region where a boundary can be expected to lie between the button-head attachment part and the button-head holding part of the combination device.

In the illustrated embodiment this weakening comprises a triangular hole 9 with the apex 9*a* of the triangle facing downwards. A further weakening 10 may also be provided adjacent the upper part 9*b* of the triangular hole 9 in the border region between the attachment part and the holding part of said device, this further weakening 10 simplifying the unitary removal of the section 5*b* and 5*c* of the attachment part.

The invention is not restricted to the described and illustrated embodiments, and modifications can be made within the scope of the following Claims.

What is claimed is:

1. A quickly attachable button arrangement, comprising:

a button head;

means for attaching and holding said button head to a material, said attaching and holding means being formed integrally with said button head and connected thereto by a shaft;

said attaching and holding means including a needle-like part having a point at a first end thereof for piercing the material and a helical thread formed about a portion of said needle-like part for screwing the attaching and holding means through the material;

one end of said helical thread forming a surface at a second end of the needle-like part, said surface located at a predetermined distance from said button head and facing theretowards so as to engage the material between the button head and said surface; and a weakening provided in the needle-like part so that the first end thereof can be readily separated from the second end thereof, said weakening and helical thread arranged so that at least a portion of said helical thread is provided on the needle-like part between the second end thereof and the weakening.

2. The button arrangement of claim 1, wherein said helical thread comprises two leads.

3. The button arrangement of claim 1, wherein the weakening is located at a distance from the surface that is approximately equal to one half the pitch of the helical thread.

4. The button arrangement of claim 1, wherein the helical thread comprises a triangular head arranged about a substantially cylindrical portion of the needle-like part.

5. The button arrangement of claim 4, wherein the pitch of the helical thread is about three times the width of the triangular band.

6. The button arrangement of claim 1, wherein the weakening comprises a hole that extends through the needle-like part.

7. The button arrangement of claim 1, wherein the weakening comprises a triangular hole.

8. The button arrangement of claim 1, wherein the one end of the helical thread forms a plurality of mutually adjacent surfaces for engaging the material between the button head and the surfaces.

9. The button arrangement of claim 8, further including a circular surface concentric with said shaft and adjacent the plurality of mutually adjacent surfaces for engaging the material between the button head and the surfaces.

10. The button arrangement of claim 1, wherein the helical thread is radially widest at the second end thereof.

* * * * *